United States Patent [19]

Pacini

[11] 4,090,376

[45] May 23, 1978

[54] APPARATUS FOR RECEIVING FABRIC PRODUCED BY A CIRCULAR KNITTING MACHINE

[75] Inventor: Edo Pacini, Prato, Florence, Italy

[73] Assignee: FIMEC S.p.A., Florence, Italy

[21] Appl. No.: 694,843

[22] Filed: Jun. 10, 1976

[51] Int. Cl.[2] ..... D04B 15/88

[52] U.S. Cl. ..... 66/153

[58] Field of Search ..... 66/153, 152, 147, 149 R

[56] References Cited

U.S. PATENT DOCUMENTS

| | | | |
|---|---|---|---|
| 1,061,024 | 5/1913 | Swinglehurst | 66/149 R |
| 2,723,546 | 11/1955 | Buckreus | 66/147 |
| 3,872,692 | 3/1975 | Miyagawa et al. | 66/153 X |
| 3,983,720 | 10/1976 | Eschenbach et al. | 66/147 |

*Primary Examiner*—Wm. Carter Reynolds

*Attorney, Agent, or Firm*—J. Harold Nissen

[57] ABSTRACT

Apparatus for receiving and storing fabric knitted on a circular knitting machine comprises a carriage movable along the ground and which carries a fabric-receiving container. The carriage is engaged beneath the needle cylinder and other rotary parts of the machine to rotate therewith so that the container receives the fabric during knitting.

13 Claims, 8 Drawing Figures

APPARATUS FOR RECEIVING FABRIC PRODUCED BY A CIRCULAR KNITTING MACHINE

FIELD OF THE INVENTION

The invention relates to apparatus for receiving fabric produced by a circular knitting machine.

SUMMARY OF THE INVENTION

This invention is concerned with an improved apparatus for receiving and storing fabric from a circular knitting machine having a rotary unit which includes a cage structure for centering a movable fabric receiving container under the rotary unit. The cage structure is provided to connect the container with the rotary unit so that it rotates coaxially with the rotary unit. With the present invention, it is possible to quickly assemble the fabric receiving container under the rotary unit so that it is centered and aligned therewith.

According to the invention, there is provided apparatus for receiving fabric from a circular knitting machine having a rotary unit, said apparatus comprising carriage means movable along the ground, container means for the fabric, said container means being movable by the carriage means, means for engaging the carriage means beneath the rotary unit of the machine such that the carriage means rotates with the rotary unit, and means for centering the carriage means in its engaged position beneath the rotary unit.

BRIEF DESCRIPTION OF THE DRAWINGS

Embodiments of the invention will now be described, by way of example only, with reference to the accompanying diagrammatic drawings, in which.

DESCRIPTION OF THE PREFERRED EMBODIMENTS

Figure 1:
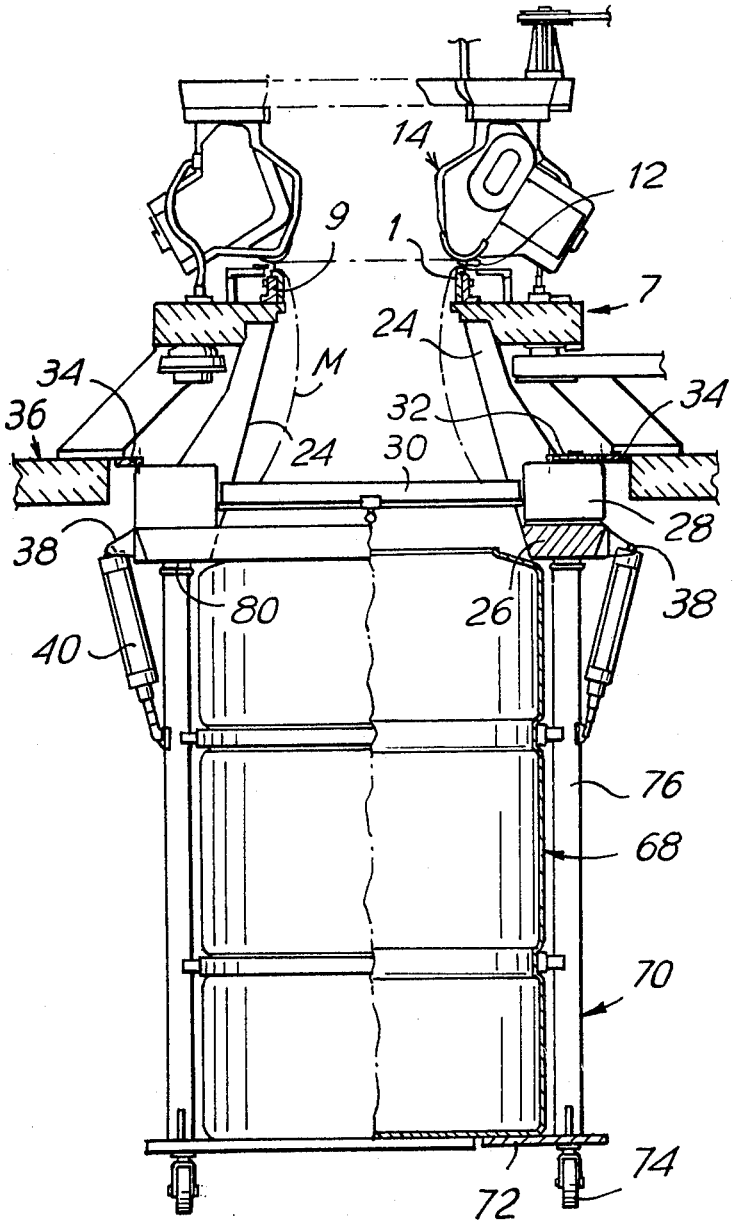
FIG. 1 is a side elevation of a circular knitting machine incorporating a first embodiment of fabric-receiving apparatus in accordance with the invention.
Figure 2:
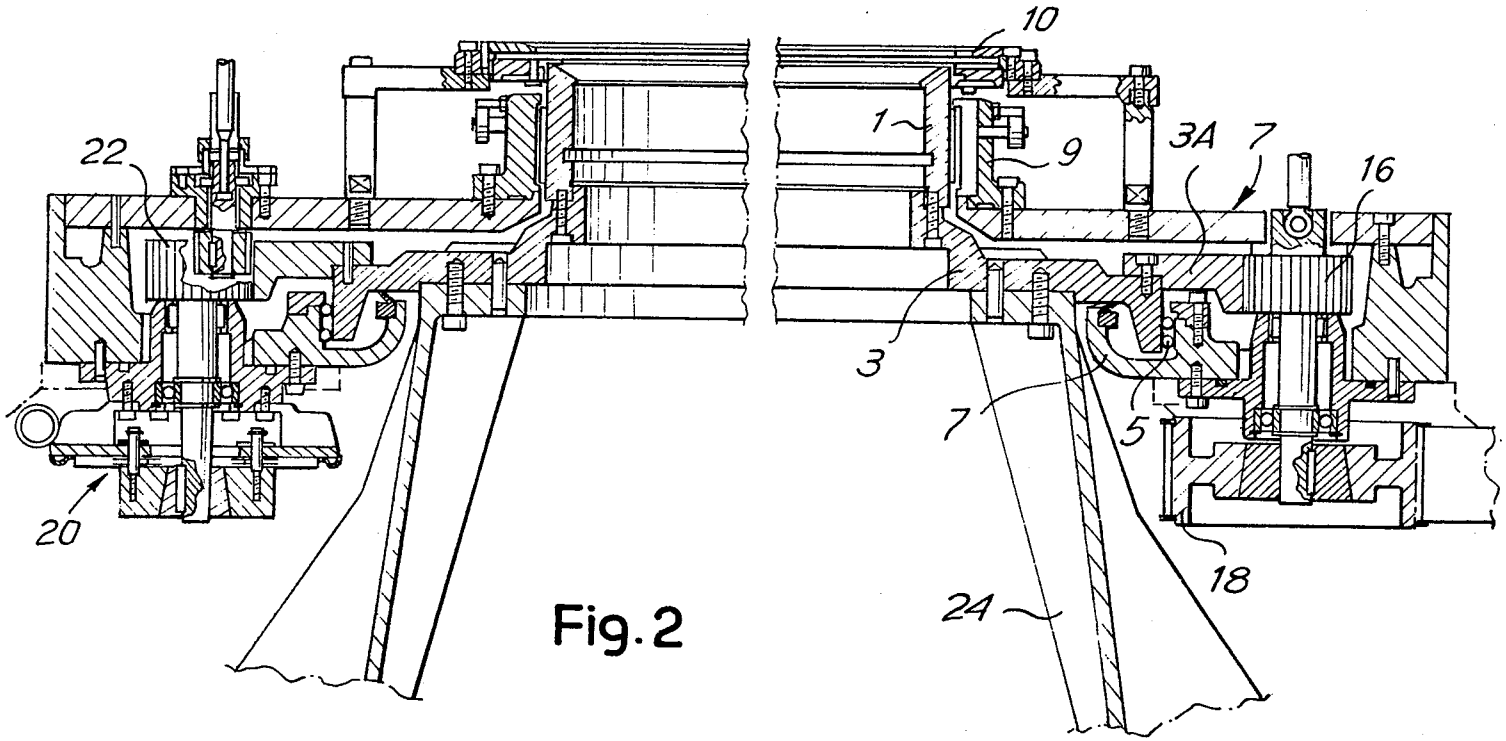
FIG. 2 is a section, to an enlarged scale, of the upper portion of the knitting machine.
Figure 3:
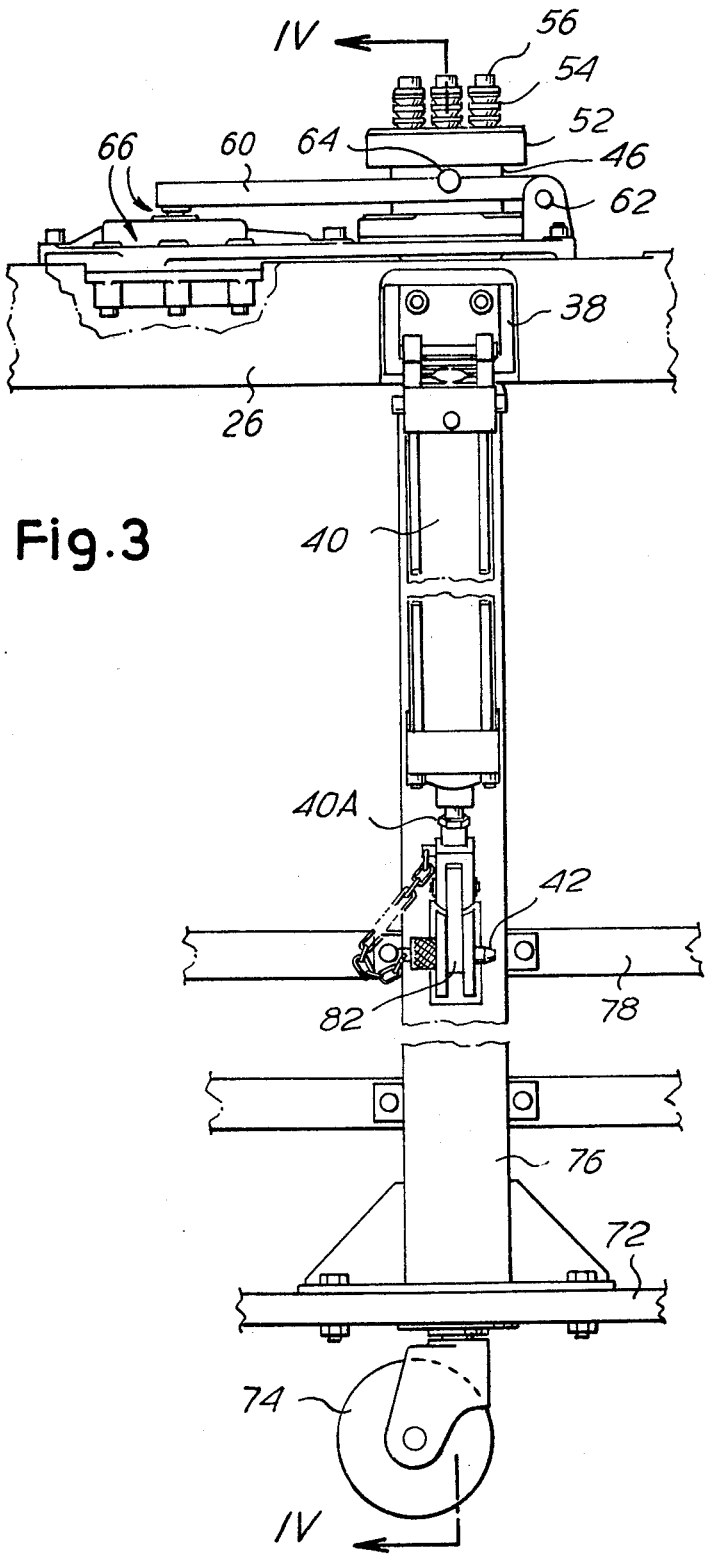
FIG. 3 is a fragmentary side elevation, to an enlarged scale, showing lifting and locking means of the apparatus shown in FIG. 1.
Figure 4:
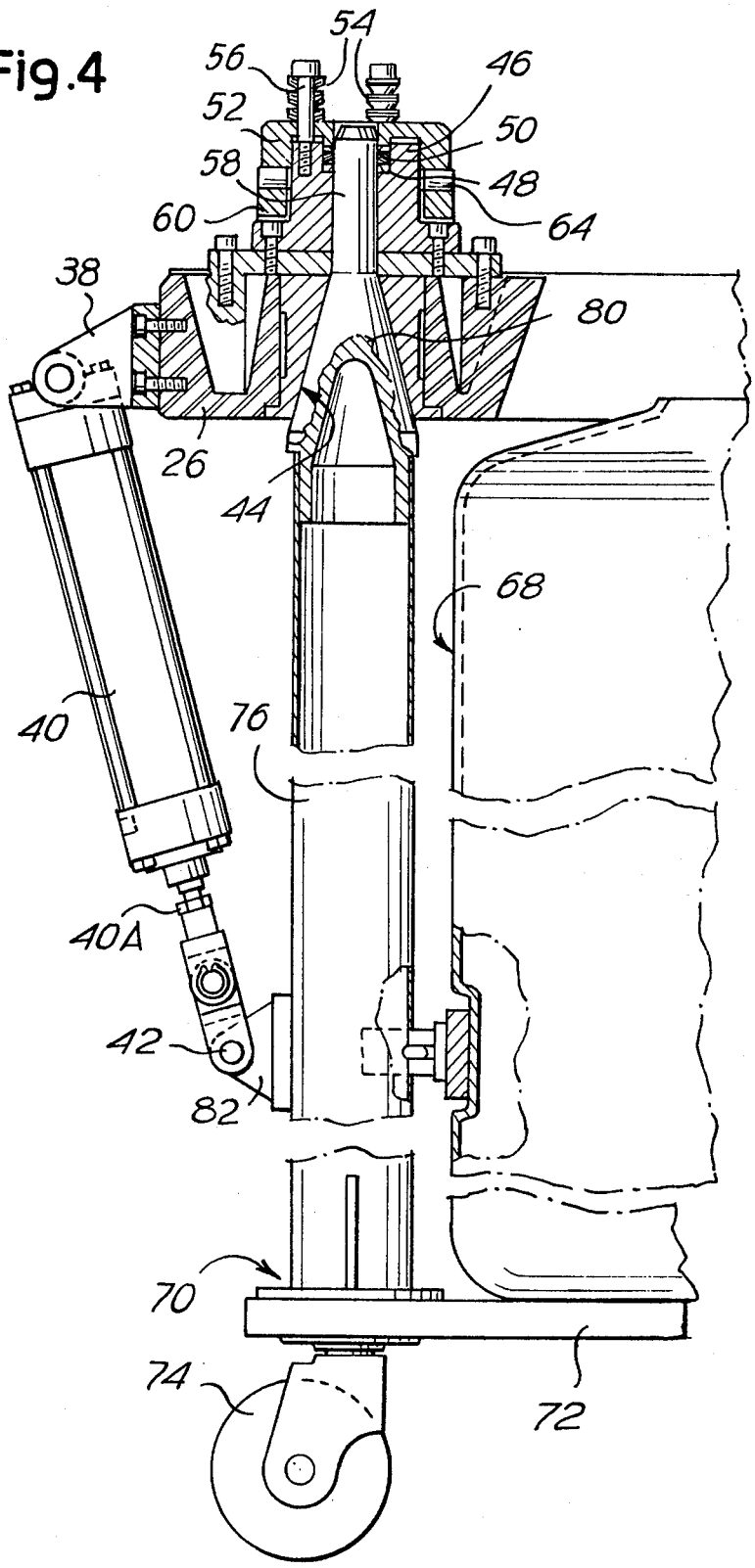
FIG. 4 is a section, taken on line IV—IV of FIG. 3.
Figure 5:
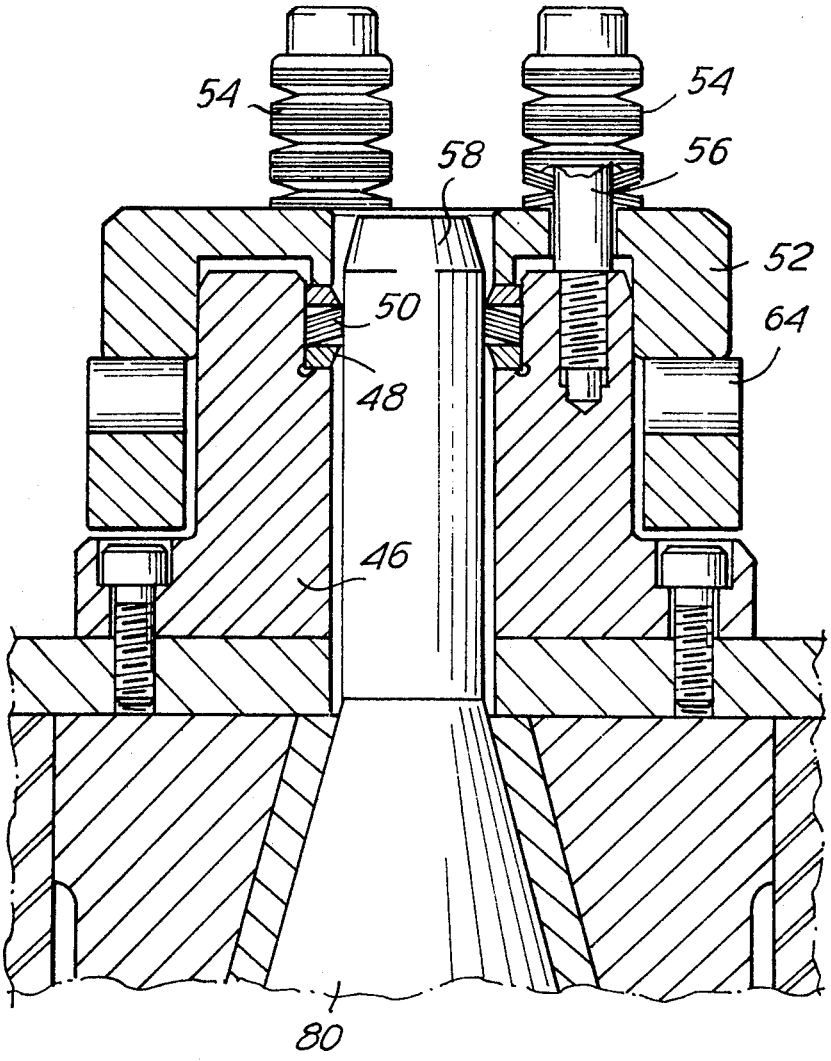
FIG. 5 shows a detail of FIG. 4.

There is shown in FIGS. 1 to 5, a circular knitting machine comprising a needle cylinder 1 which is rigid with a ring 3 which is supported via ball bearings or any other suitable means, from a stationary structure 7. A jacket or shell 9 surrounding the needle cylinder 1 and serving to control the needles of the cylinder through appropriate cams is also supported by the structure 7. Around the upper zone of the needle cylinder, which is the working zone of the needles, there is provided a structure 10 which cooperates with members to be operated in combination with the needles. Above the needle cylinder 1 there are provided yarn feed devices 14 of a known type. The ring 3 is rigid with a toothed rim 3A which is rotated by a gear 16 having a drive shaft which is driven by a pulley 18 actuated by a drive belt. Associated with the toothed rim 3A are braking means, for example one or more electromagnetic brakes 20, which act on gears 22 engaged with the toothed rim 3A to obtain a braking action against the relatively high inertia of the rotating unit formed by the needle cylinder 1 and the parts rotating with the needle cylinder 1, for the hereinafter stated reasons. Apart from the presence of the braking means, the hitherto described arrangement is known per se.

An assembly of supporting arms 24 extending from a lower supporting ring 26 which serves to support a container for a tubular fabric M which is knitted on the machine is connected with the rotating unit 1, 3, 3A. On the ring 26 there are located two diametrically opposed boxes 28 which support a pair of rollers 30 arranged side-by-side to stretch and tension the tubular fabric M knitted on the machine. At least one of the boxes 28 contains a speed reducer actuated by a friction wheel or by a gear 32 engaging, respectively a rolling track or a stationary ring 34 borne by a frame 36, from which the structure 7 is carried during rotation of the needle cylinder 1, the gear 32 rolls along the ring 34 and thus drives the rollers 30 to stretch and tension the fabric M.

As stated above, the inner ring 26 serves to support a container for the fabric being formed. For this purpose the ring 26 has pairs of struts 38, to which a corresponding number of pneumatic cylinders 40 are linked to form pneumatic lifting units. The piston rod 40A (FIGS. 3 and 4) of each cylinder 40 has a seat for a removable pin 42 for the hereinafter indicated purposes.

In the ring 26 there are formed substantially frustoconical and downwardly open seats 44, in correspondence of which above the ring 26 there are provided members 46 which are axially and vertically bored. In each member 46, around the bore therein, there is formed an upper seat 48 for a plurality of elastic split-pinned locked washers 50 (FIG. 5) which are arranged in the seat 48 to cooperate with the outer wall of the seat 48. A cover member 52 is arranged above each of the members 46 and has an inner annular edge which engages the split-pinned washers 50. Springs 54, arranged around studs 56 engaging each member 46, act on the cover member 52 to deform the split-pinned washers 50 in a sense to flatten the washers 50 and reduce their inner diameter. This arrangement forms a locking system for a pin 58 which is inserted in the bore of the member 46. This locking system can be released by raising the cover member 52. This may be obtained by means of a forked lever 60 which is linked at 62 to the member 46 and which acts through rollers 64 to raise the cover member 52 against the action of the springs 54. Each of the levers 60 is operable by a respective pneumatic jack 66 which is carried by the ring 26, or by suitable electrically-operated means. The corresponding jacks 66 are simultaneously operated in the hereinafter indicated manner for releasing the locking means while locking of the pin 58 takes place by the action of the springs 54. Also the cylinders 40 are simultaneously operated for the hereinafter indicated purposes.

A large capacity cylindrical container 68 is hooked under the ring 26 to receive the fabric formed during a relatively long period of time of the operation of the machine. The container 68 is mounted on a carriage or trolley 70. The carriage 70 comprises a platform 72 (on which the container 68 rests or which forms a part of the container), rollers 74, at least some of which are in the form of castors, and columns 76 arranged around the container 68 and preferably provided with bands 78 which surround and center the container. The container may also be made and combined with the carriage 70 in such a manner to allow the possible removal of the container from the carriage, if this is required. Each of the columns 76 has, at its upper end, a tapered and preferably frusto-conical spigot 80 which cooperates with a respective one of the seats 44 and from which a corresponding pin 58 extends upwardly.

The carriage 70 with the container 68 may be moved on the floor, with respect to which the knitting machine is fixedly positioned at a preset position; the height of the annular ring 26 from the floor is such that the carriage, including the pins 58, may move under the ring 26. Appropriate means are provided to center the carriage 70 and its columns 76, in such a manner to axially align the spigots 80 and the pins 58 with the seats 44. Lugs 82 are provided on the carriage 70 (and preferably on the columns 76 thereof) to receive the pins 42 of the cylinders 40 when the cylinders are in their extended state, whereby to connect the lower ends of the piston rods 40A with the lugs 82. Once this connection is effected with the machine at a stand-still, the cylinders 40 and the jacks 66 can be actuated to lift the carriage 70 and the container 68 until the pins 58 and the spigots 80 penetrate the seats 44; the actuation of the jacks 66 to lift the cover members 52 facilitates the insertion of the pins 58 into the washers 50, although actuation of the jacks 66 is not essential. After lifting of the carriage and the container, the springs 54 which act on the washers 50 in the flattening direction ensure locking of the pins 58 in the assembly 26, 46 and thus prevent the release of the carriage and of the container from the rotary unit formed by the needle cylinder and the parts rotating therewith. At this stage, supply of compressed air to the cylinders 40 can be terminated.

The feed of the compressed air and possibly also of the electric power to the components mounted on the rotary unit is provided by means of a loose conduit which extends from a stationary supply socket. The outer end of the conduit is plugged into an appropriate socket arranged on the ring 26 or in another suitable position on the rotary unit. At the end of knitting when the fabric is stored in the container 68 and with the knitting machine stopped it is possible to feed compressed air to the jacks 66 for releasing of the carriage 70 and the container 68 from the ring 26, and to feed the cylinders 40 to lower the carriage and the loaded container to the floor for removal and replacement. The arrangement of the conduit, its plug, and the sockets is such that the machine cannot be started until the plug at the end of the conduit has been removed from the socket on the rotary unit and inserted into the stationary supply socket; thus, the possibility of damage to the conduit is reduced.

In the embodiment shown in FIGS. 6, 7 and 8 the rotary unit comprises three vertical rods 92, which are fixed at their lower ends to a rotary table or platform 94 arranged at the level of the floor P below the machine; the table 94 is rotatably mounted by means of a pin 96 on a support 98 embedded within the floor. The table 94 has a pair of rails 100 which serve to guide the wheels 102 of a container 104 and can be used to center the container 104 in one direction. In the FIGS. 6–8 embodiment, four boxes are connected with lower supporting ring 26. While only two boxes are shown, four are necessary. Each of the rods 92 are linked with a box 28, although a separate linkage (not shown) directly to the ring 26 can be provided. The orientation of the rails 100 is such as to allow the insertion of the container 104 according to the arrow f10 within the cage structure formed by the three rods 92; a fourth rod 106 is linked at 108 to the box 28, so that it can be raised (as shown in FIG. 8) to allow the insertion of the container 104; the rod 106 may be retained in the raised position by means of a retaining collet 110, and can be lowered in the direction of the arrow f12 to a substantially vertical position and fixed to the table 94 to complete the cage which retains the container 104 in position. The rods 92, 106 are equally spaced around the table 94. Suitable pads 112 may be provided to center the container 104. The vertical rods 92 and cooperative pads 112 assure coaxial rotation of the container 104 relative to the driving rotary unit. A carriage is provided which includes plate 102C which carries wheels 103 and may be connected with the base of container 104 or be formed integral therewith.

In this arrangement, the container may be moved along the floor P and onto the table 94, so as to be introduced into the cage formed thereby and by the rods 92, 106. Once the rod 106 is locked in its vertical position, the container forms a part of the rotary unit of the machine to receive the fabric being knitted. The container together with the fabric stored therein may be rolled out of the cage after opening the cage by lifting the rod 106.

With the apparatus described, it is possible to store a relatively large amount of knitted fabric thus reducing the frequency of the interruptions in the operation of the machine, to replace the container. Further, the apparatus permits the production of very long pieces of fabric with few junctions in the fabric. This results in a high saving of material and labor. The saving derives from: the smaller number of stops in the operation of the machine; the shorter duration of each stop; the smaller number of junctions to be made; the smaller overall reject due to the smaller number of junctions; and higher operational manoeuvrability.

On the other hand, the container even if very heavy can be readily attached to, and detached from, the rotary unit thus reducing the idle time. Also with a large quantity of fabric which has been stored in the container, the rotary unit can be stopped relatively quickly by using the brake means 20 or other suitable brakes.

Figure 6:
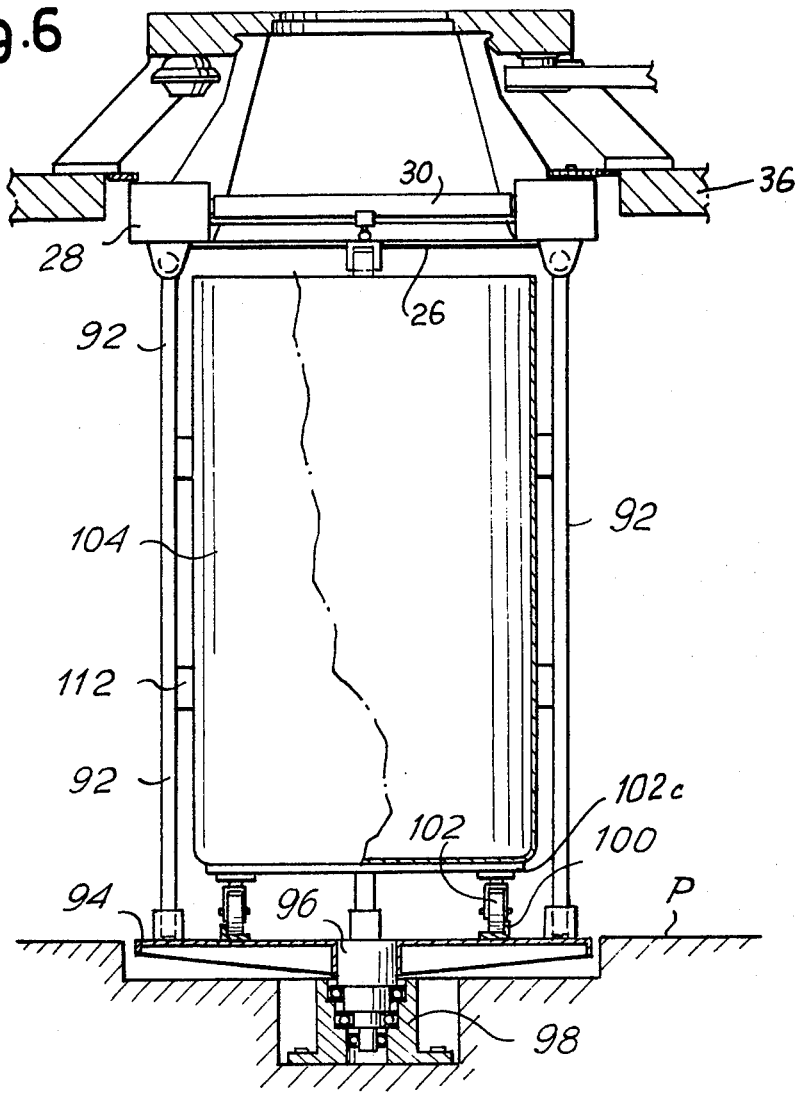
FIG. 6 is a fragmentary vertical section of a second embodiment of the invention.
Figure 7:
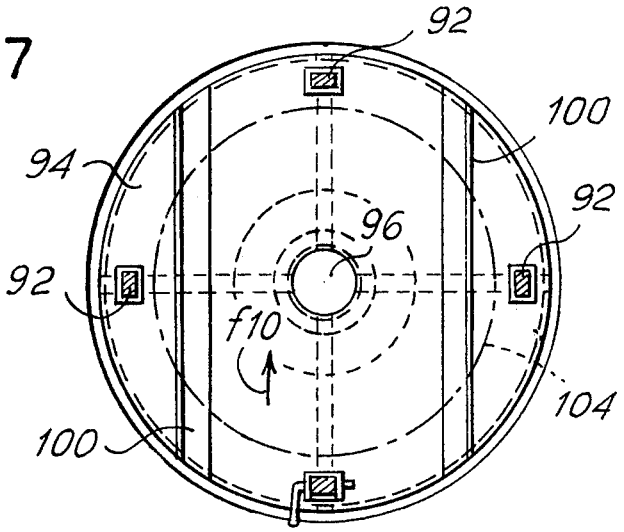
FIG. 7 is a horizontal section of the apparatus shown in FIG. 6.
Figure 8:
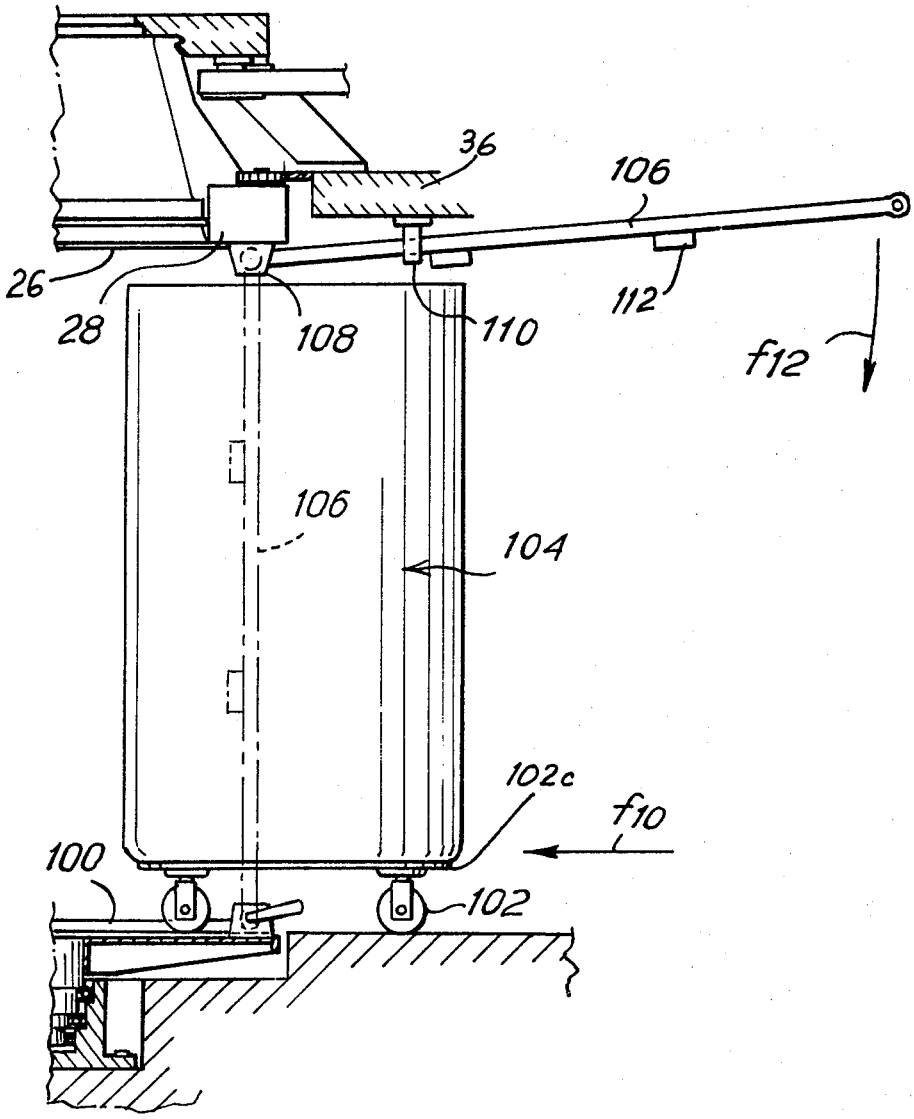
FIG. 8 is a fragmentary vertical section showing the apparatus of FIG. 6 during loading of a fabric-receiving container.

In a modified form of the embodiment shown in FIGS. 6 to 8, the table 94 may be raised and reached by an inclined ramp along which the wheels 102 of the container 104 can move.

The apparatus particularly described is particularly suitable for use with imitation fur or other bulky fabrics.

What is claimed is:

1. Apparatus for receiving fabric from a circular knitting machine having a rotary unit, comprising:

carriage means movable along the ground;

container means for receiving the fabric;

said container means being movable by said carriage means;

means comprising a cage structure for positioning said carriage means beneath the rotary unit of the machine such that said carriage means rotates with the rotary unit;

means defining a bottom support surface to support said carriage means in said cage structure comprising a rotatable platform;, said carriage means being movable off said rotable platform said cage structure further comprising a series of rods extending upwardly from said platform to the rotary unit such that the rods link said platform to the rotary unit for rotation therewith; and, means for centering said carriage means in an engaged position beneath the rotary unit to insure that said carriage means rotates coaxially with the rotary unit.

2. Apparatus according to claim 1, wherein the container means is separate from the carriage means.

3. Apparatus according to claim 1, wherein the container means is an integral part of the carriage means.

4. Apparatus according to claim 1, wherein:

said carriage means includes wheels;

said container means being carried by said wheels; and said centering means includes rails on said bottom support surface to guide said wheels for insertion of said container means within said cage structure.

5. Apparatus according to claim 1, wherein:

said means for centering said carriage means comprise said cage structure.

6. Apparatus according to claim 1, wherein:

said cage structure comprises means defining a side opening for said carriage means.

7. Apparatus according to claim 1, wherein:

said centering means includes pads on said cage structure.

8. Apparatus according to claim 1, wherein:

said centering means includes rails on said platform.

9. Apparatus according to claim 6, wherein:

said cage structure includes four said rods equally shaped around the platform, and one of said four rods is releasable from the platform and can be raised from the platform to form said side opening to permit insertion of the carriage means into the cage structure.

10. Apparatus according to claim 1, wherein:

said means for centering said carriage means comprise said cage structure, said cage structure comprises means defining a side opening for said carriage means, and said support surface being positioned substantially at floor level.

11. Apparatus for receiving fabric from a circular knitting machine having a rotary unit, comprising:

carriage means movable along the ground;

container means for receiving the fabric, said container means being carried by said carriage means for movement thereby;

a rotatable platform aligned with said rotary unit, said carriage means being movable onto and off from said rotatable platform;

means for centering said carriage means beneath the rotary unit for coaxial rotation therewith in an engaged position of said carriage means, said centering means including a cage structure, said cage structure comprising a series of rods extending upwardly from said platform to the rotary unit such that the rods link said platform to the rotary unit for rotation therewith; and, said cage structure rotating said carriage means and said container means in synchronism with the rotary unit in said engaged position of said carriage means so that said carriage means rotates coaxially with the rotary unit.

12. Apparatus according to claim 11, including: rail means for receiving said carriage means and positioning said container means in alignment with the rotary unit.

13. Apparatus according to claim 11, wherein:

said carriage means includes wheels connected with said container means.

* * * * *